United States Patent [19]

Koehler et al.

[11] Patent Number: 5,046,418

[45] Date of Patent: Sep. 10, 1991

[54] DAMPENING METHOD AND APPARATUS FOR AUTOMATIC INK/WATER CONTROL FOR LITHOGRAPHIC PRINTING PRESS

[75] Inventors: James E. Koehler, Montreal, Canada; David W. Paularena, Marietta; Richard G. McCaffrey, Woodstock, both of Ga.

[73] Assignee: Dahlgren International, Inc., Dallas, Tex.

[21] Appl. No.: 482,917

[22] Filed: Feb. 23, 1990

[51] Int. Cl.[5] ..... B41F 7/26

[52] U.S. Cl. ..... 101/148; 101/350; 101/451

[58] Field of Search ..... 101/147, 148, 350, 451

[56] References Cited

U.S. PATENT DOCUMENTS

| | | | |
|---|---|---|---|
| 3,168,037 | 2/1965 | Dahlgren | 101/148 |
| 3,911,815 | 10/1975 | Banfer | 101/148 |
| 3,937,141 | 2/1976 | Dahlgren | 101/148 |
| 4,676,156 | 6/1987 | Aylor et al. | 101/148 |
| 4,724,764 | 2/1988 | MacPhee et al. | 101/148 |
| 4,949,637 | 8/1990 | Keller | 101/148 |

*Primary Examiner*—Clifford D. Crowder
*Assistant Examiner*—Ren Yan
*Attorney, Agent, or Firm*—Sixbey, Friedman, Leedom & Ferguson

[57] ABSTRACT

The dampening apparatus and method provides automatic ink/water control for a lithographic printing press by means of a hydrophylic metering roll in a pan for fountain solution which contacts an oleophylic transfer roll. The transfer and metering rolls are free wheeling friction driven rolls which are driven in substantially a one-to-one surface speed ratio by friction between the transfer roll and a dampener form roll to cause the metering roll to provide an unmetered excess of dampening fluid from the pan to a nip with the transfer roll. The dampener form roll is positively driven from the drive system for the press plate cylinder at a one-to-one surface speed ratio with the plate cylinder and is a resilient oleophylic roll having a durometer within the range of 20 to 30 durometer. The transfer roll is harder and of different diameter than the dampener form roll with a durometer in the range of from 30 to 60 durometer.

17 Claims, 2 Drawing Sheets

DAMPENING METHOD AND APPARATUS FOR AUTOMATIC INK/WATER CONTROL FOR LITHOGRAPHIC PRINTING PRESS

FIELD OF THE INVENTION

The present invention relates generally to dampening systems for lithographic printing presses and more particularly to a dampening method and apparatus for providing automatic ink/water control to a lithographic printing press plate.

BACKGROUND OF THE INVENTION

One of the greatest problems since the inception of lithographic offset printing has been to achieve the application of moistening or dampening fluid to the surface of a lithographic printing plate in uniform and evenly distributed quantities and in regulated amounts so as to assure a uniformly good reproduction of a printed image on paper. As is well-known, a lithographic offset printing plate is chemically treated to provide an ink receptive printing area and a hydrophylic or moisture receptive non-printing area. The film of dampening fluid which is applied to the surface of the plate is retained by the hydrophylic area where ink is rejected. The printing area receives both water and ink. Therefore, only the image of the printing area is transferred to the blanket cylinder of the lithographic printing press and from there to the paper on which the image is printed.

In the past, an early dampening system for a lithographic printing press consisted of a pan of water in which a metallic pan roller rotated. An oscillating ducter roller alternatively rotated in contact with the pan roller and a vibrating metal roller which in turn was in rotative contact with one or more fabric-covered rollers that contacted the printing plate. The moisture that was transferred from the fabric-covered rollers to the printing plate was dependent to a great extent upon the moisture absorbed in the fabric covering material. With such dampening systems, the plate is subject to frictional wear due to contact with the fabric-covered dampening rollers, and the fabric soon became impregnated and contaminated by the ink which accumulated thereon from continued exposure to the image area of the printing plate. To compensate for this condition, additional water was fed to the ink impregnated areas of the dampening rollers, but this caused an excessive amount of moisture to be directed to the less ink impregnated areas of the rollers.

In an attempt to solve the problems presented by the fabric-covered dampening rollers, a continuous-duty, plate contacting, inker feed dampening system was developed to eliminate the fabric-covered dampening rollers. Such inker feed dampening systems generally include a pan roller which may be a metallic or resilient-covered roller rotatably disposed in a pan of dampening fluid. A resilient non-absorbent metering roller is impressed against, and is in rotative contact with a hydrophylic transfer roller so as to transfer dampening fluid to the hydrophylic surface of the transfer roller. The transfer roller is preferably chrome-plated and has an exterior surface which is highly polished and treated so as to render the same moisture receptive or hydrophylic. Often this transfer roller is a chemically etched roller which rotates in contact with an ink form roller. Dampening solution is metered into a relatively thin film by the metering nip formed between the chrome transfer roller and the resilient metering roller, and this metered film of dampening solution moves to a nip between a first ink form roller and the transfer roller so as to then be transferred to the plate cylinder. The transfer roller and the metering roller are positively driven at a slower speed than the form roller so that a "slip nip" is formed at the juncture of the transfer roller and an ink-coated applicator roller. Such an inker feed dampening system is illustrated by U.S. Pat. No. 3,168,037 to H. P. Dahlgren.

Continuous-duty, plate-contacting, inker feed dampening systems generally provide a relatively fast response time at the beginning and during a printing run with controlled water in ink emulsification, so as to limit the number of sheets of paper which are wasted to provide acceptable printed copies. However, such dampening systems normally require a water soluble organic liquid, such as isoprophyl alcohol, to be added to or used as the dampening fluid to reduce the surface tension of the water in the fluid and to prevent a water film from collecting ink globules on the surface of the form roller from the hydrophylic chrome transfer roller.

The control of dampening fluid supplied by an inker feed dampening system is achieved by separate motor drives which drive at least one of the dampening system rollers at a slower speed than the plate cylinder, while other rollers in the dampening system run at essentially the same surface speed as the plate cylinder. Additional adjustment of the dampening fluid supply is obtained by varying the pressure (stripe) between dampening system rollers and sometimes by varying press speed.

Many modifications have been made to the typical continuous-duty inker feed dampening system in an attempt to rectify such problems as ghosting and ink emulsification. A chrome roller has been run at the same speed as the dampener form roller while a resilient roller has been placed to function as a transfer roller while being driven by a variable speed motor. A second chrome roller is placed in the pan against the resilient rollerand in this system, only the dampening form roller carries ink.

In another modification, a separate dampening form roller has been employed in contact with the chrome transfer roller and a bridge roller is used to connect the dampening form roller to the first ink form roller for the system. This basic configuration has been further modified by positively driving the separate dampener form roller and the bridge roller at a speed different from that of the plate cylinder. Such a system is shown by U.S. Pat. No. 4,724,764 to J. McPhee et.al.

Prior dampening systems of the type described which incorporate "slip nips" between various system rollers require adjustment of roller settings and/or speeds to obtain a desired ink/water balance. These settings or speeds must also be adjusted as press speeds vary, or with a variation in printing plates, inks, paper, fountain solutions, and the other variables. Also, as previously indicated, when chrome transfer rollers are used in contact with an ink form roller, the use of a dampening fluid containing a water soluble organic liquid is required.

DISCLOSURE OF THE INVENTION

It is a primary object of the present invention to provide a novel dampening method and apparatus for automatic ink/water control for a lithographic press which requires no adjustment of roller settings or speeds to obtain ink/water balance, and which provides such balance for varying press speeds and with any plate format.

Another object of the present invention is to provide a novel and improved dampening method and apparatus for automatic ink/water control for lithographic printing presses which permits the ink to naturally accept the amount of dampening fluid which it has the ability to take and which returns the balance of the dampening fluid back to a supply pan.

A further object of the present invention is to provide a novel and improved dampening apparatus for automatic ink/water control for lithographic printing presses which includes an oleophylic transfer roll and a hydrophylic metering roll which functions as a pan roller. The transfer and metering rollers are freely driven through friction only, and are in constant contact. The transfer roll is in friction contact with a dampener form roll which in turn is gear driven with an overriding clutch from the plate cylinder of the lithographic printing press. Thus, no slip nips are present in the dampening system.

Yet another object of the present invention is to provide a novel and improved dampening apparatus for automatic ink/water control for lithographic printing presses which operates effectively without alcohol in the dampening solution and which prevents the dampening solution in a pan from becoming contaminated with ink particles. The dampening apparatus is a continuous-duty dampener where the pressure between the dampener rolls is not critical to effective dampener operation. The dampener rolls remain in contact at all times, whether or not the dampener is in operation, and consequently the dampener form roll is pre-wetted so that sheet waste is substantially eliminated at the beginning of a press run.

A still further object of the present invention is to provide a novel and improved dampening apparatus for automatic ink/water control for lithographic printing presses which includes a hydrophylic metering roll in a pan for fountain solution which contacts an oleophylic transfer roll. The transfer and metering rolls are free wheeling friction driven rolls which are driven in substantially a one-to-one surface speed ratio by friction between the transfer roll and a dampener form roll and between the transfer roll and the metering roll. The dampener form roll may be positively driven from the drive system for the press plate cylinder at a one-to-one surface speed ratio with the plate cylinder and is a resilient, oleophylic roll having a durometer within the range of 20 to 30 durometer. The transfer roll is harder and of a different diameter than the dampener form roll with a durometer in the range of from 30 to 60 durometer. Throughout this application, mentioned durometer values are shore durometer values.

DESCRIPTION OF THE PREFERRED EMBODIMENTS

Figure 1:
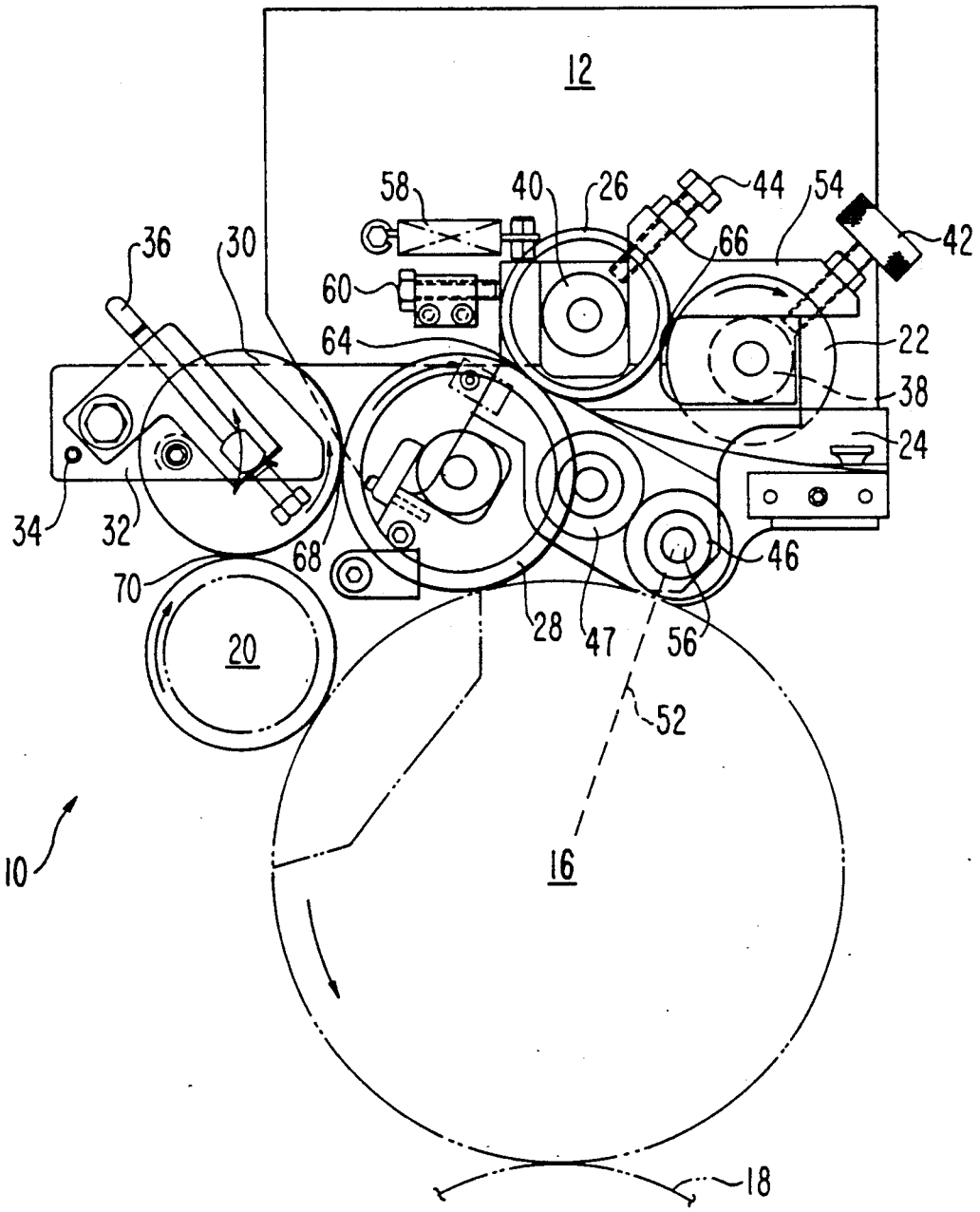
FIG. 1 is a diagrammatic view of the dampening apparatus for automatic ink/water control for lithographic printing presses of the present invention.
Figure 2:
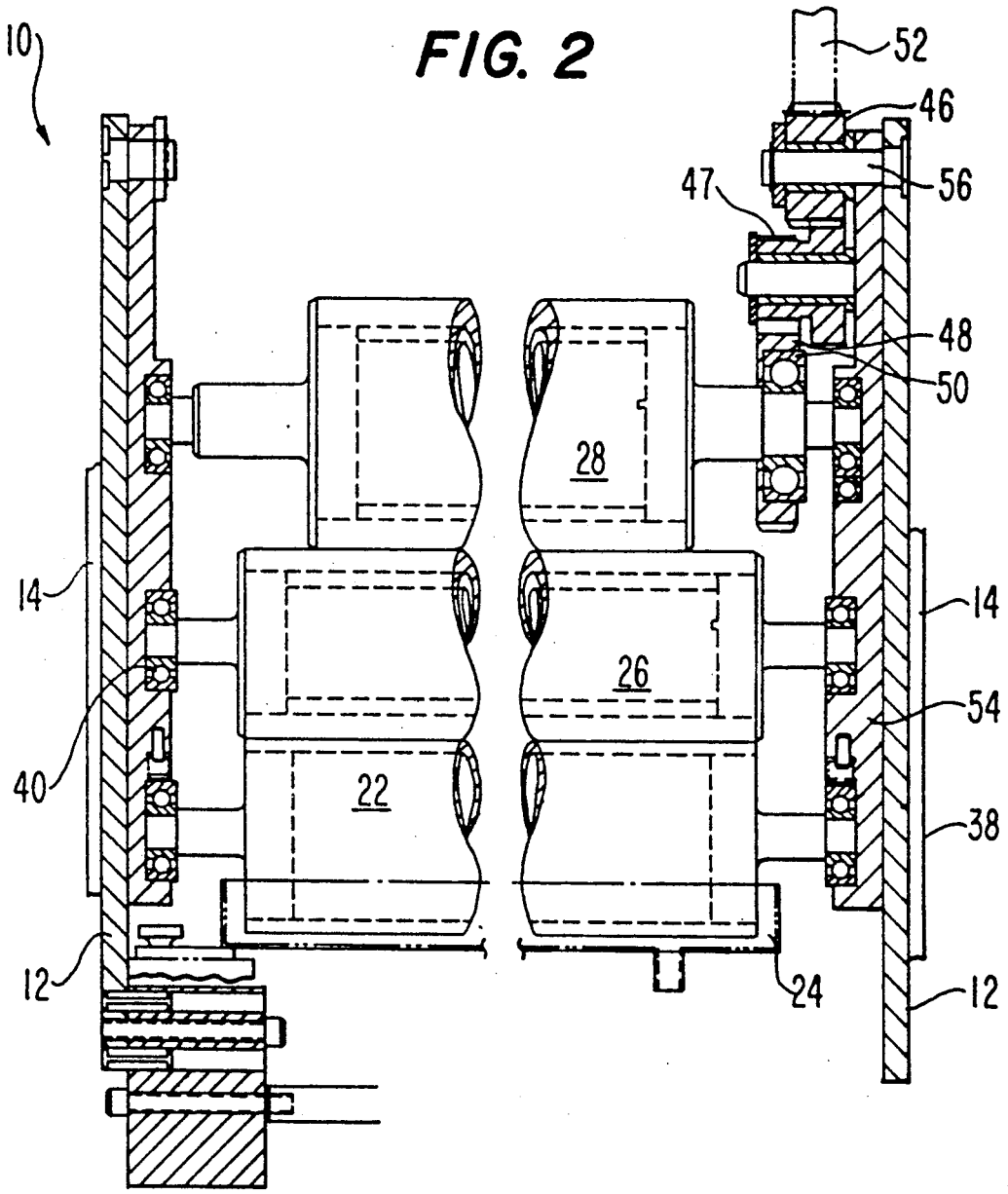
FIG. 2 is a view in front elevation of a portion of the dampening apparatus of FIG. 1.

Referring now to FIGS. 1 and 2, the dampener assembly of the present invention indicated generally at 10 includes two spaced dampener side frames 12 upon which the dampener components are mounted. The side frames mount the dampener assembly in operative position between the side frames 14 of a lithographic press so that the dampener will provide dampening fluid to a printing plate mounted on the press plate cylinder 16. The plate cylinder is in contact with a blanket cylinder 18, and the plate cylinder and blanket cylinder are mounted upon the press side frames 14 in a conventional manner. Ink is provided to the plate cylinder 16 by the first ink form roll 20 of a conventional inking system for lithographic presses.

The dampener assembly 10 includes a metering roll 22 which is immersed in the fountain or dampening solution contained in a pan 24. This metering roll is a metallic, hydrophylic roll having a highly polished, treated surface so as to render the roll moisture receptive. The metering roll is preferably formed by the conventional chrome-plated roll surface which has been ground, polished and treated after chrome plating to render it hydrophylic. Generally, the chrome surface of the roll is bathed with a solution of hydrochloric acid and gum arabic water solution to remove existing deposits of chromium oxide and to prevent further oxidation.

The hydrophylic metering roll picks up water or other fountain solution from the pan 24 for transfer to an ink layer carried on an oleophylic transfer roll 26 which is in rolling contact with the metering roll. The transfer roll 26 is a resilient covered roll of hard rubber or plastic and is primarily ink receptive rather than water receptive. This transfer roll is in turn in rolling contact with a dampener form roll 28 which contacts the plate cylinder 16. This dampener form roll, like the transfer roll 26, is a resilient covered oleophylic roll of rubber or plastic. However, the dampener form roll is softer than the transfer roll, with the form roll preferably being a rubber roll within the range of between 20 and 30 durometer. The transfer roll is a rubber roll having a different durometer than that of the form roll, and is preferably a rubber roll having a durometer range of from 30 to 60. A 50 durometer transfer roll has been found to operate very effectively with a dampener form roll having a durometer from 25 to 30.

An ink receptive oscillating roll 30 of a conventional type is mounted to operate as a bridging roll between the first ink form roll 20 and the dampener form roll 28. This oscillating roll is mounted upon a support 32 which is pivoted about a pivot post 34, and the oscillating roll is biased into contact with the ink form roll 20 and dampener form roll 28 by clamp members 36. When the clamp members are pulled upwardly, the oscillating roll 30 is moved upwardly out of contact with the ink form roll. The construction of the oscillating roll and its biasing mechanism is conventional and illustrated by U.S. Pat. No. 4,741,269 to J. E. Aylor The metering roll 22 and transfer roll 26 are supported in bearings 38 and 40, but it is important to note that the metering roll and transfer roll are free wheeling and are not driven by gearing or clutches. The position of the bearing assemblies 38 and 40 and thus the relative position of the metering and transfer rolls is adjusted by means of adjustment screws 42 and 44. Again, the details of the bearing assemblies and the adjustment means therefor are shown by the aforementioned Aylor et.al. patent.

The dampener form roll 28 is positively driven from the press by means of a dampener drive gear 46, an idler gear 47, a form roll drive gear 48 and an overrunning clutch 50. This is a conventional drive for connecting and driving a form roller from the plate cylinder drive which includes a plate cylinder drive gear 52, and insures that a substantially one-to-one surface speed drive ratio exists between the plate cylinder and the dampener form roller.

It will be noted from FIG. 1 that the metering roll 22, the transfer roll 26 and the dampener form roll 28 are all mounted on a single roll hanger 54 which is pivotally mounted between the dampener side frames 12 by a pivot pin 56 at the axis of the dampener drive gear 46. The roll hanger is spring-biased by a spring 58 to pivot the roll hanger about the pivot pin 6 so that the dampener form roll 28 is biased into contact with the plate cylinder 16. The amount of downward bias on the dampener form roll may be adjusted by a form roll adjustment screw 60. It should be noted that the metering roll 22, the transfer roll 26 and the form roll 28 are constantly in contact, and the only drive for the metering and transfer rolls is that provided by friction between the dampener form roll and the transfer roll and friction between the metering roll and the transfer roll. Therefore, there is substantially no slippage at a nip 62 between the dampener form roll and the plate cylinder, at a nip 64 between the form roll and the transfer roll, and at a nip 66 between the transfer roll and the metering roll. Also, as illustrated in FIG. 1, the transfer roll 26 is not only harder than the dampening form roll 28, but it is also of a different diameter. For example, the transfer roll may be two inches in diameter while the dampener form roll is two and three-quarters inches in diameter. This tends to reduce ghosting.

The dampener assembly 10 of the present invention is totally unlike conventional dampeners in that the hydrophylic roll is not the transfer roll in contact with the dampener form roll 28, but is instead the metering roll in the pan 24. Even more unique, however, is the fact that the metering roll 22 and the oleophylic transfer roll 26 are free wheeling and not positively driven, and this permits ink and water to come into intimate contact in the dampener system but only in a free-wheeling state with no slip or shear to alter the surface of the ink. The ink controls the rate at which it will take on water or other dampening fluid and will maintain a natural ink-/water balance unless the ink surface is disturbed by shear at one of the nips 62,64,66. Consequently, in the operation of the dampener assembly 10, a one-to-one surface-speed ratio is maintained at each of the nips, so that no shear occurs.

An amount of water in excess of the amount required for dampening is taken from the pan 24 by the hydrophylic chrome roll 22 and is transported to the nip 66 where the water or dampening fluid is brought into contact with ink on the surface of the oleophylic transfer roll 26. The transfer roll receives a layer of ink due to contact at the nip 64 with the dampener form roll 28, and the water on the metering roll 22 is moved in intimate contact with this layer of ink at the nip 66. At this contact point, the ink takes the amount of water it has the capacity to take, and the balance of the water either cascades back into the pan 24 or passes through the nip to travel back to the pan along the opposite side of the metering roll. By placing the hydrophylic metering roll in the pan, an instant return route is provided for water not required by the ink. Since the ink controls the amount of water picked up at the nip 66, various inks with different water pickup characteristics require no adjustment of the dampener.

The ink and water is now moved by the transfer roller 26 to the nip 64 where the ink and water layer on the transfer roll comes into contact with an ink and water layer on the dampener form roll 28. As the two layers come into contact under pressure, they become one, and as they separate, an equal amount of ink and water transfers to each roll. Thus, the dampener form roll transfers ink and water to the rip 62 with the plate cylinder where the normal lithographic process takes place. There is a final nip 68 between the oscillating bridge roll 30 and the form roll 28, and at this nip, the bridge roll spreads the remaining water and at the same time replenishes the ink on the dampener form roll 28. Water is also carried to the first inker form roll 20 at nip 70 by means of the oscillating roll 30 as well as by the plate cylinder 16.

Since the hydrophylic metering roll 22 is not a transfer roll, there is no need to employ alcohol or other organic fluid in the dampener pan, and the dampener assembly 10 operates efficiently with water as the dampening fluid. Also, it should be noted that the rolls 22,26,28 of the dampener assembly remain preferably in contact regardless of whether or not the plate cylinder 16 is driven by the press, and consequently dampening fluid is instantly applied when the press is restarted. It is possible to pre-wet the plate cylinder 16 by starting the press with the ink form roll removed from the plate cylinder, and the dampener unit can be washed up with the press by releasing the nip 66 between the metering roll 22 and the transfer roll 26 by means of the adjustment screw 42. Adjustment screw 44 is used to set nip pressure at the nip 64 while adjustment screw 42 is used to set nip pressure at the nip 66.

It has been found that the automatic operation of the dampener assembly 10 to provide the required amount of dampening fluid without adjustment is relatively unaffected by variations in pressure between the dampener assembly rolls. For example, the stripe between the metering roll 22 and the transfer roll 26 was varied from one-eighth of an inch to three-eighths of an inch with no change in print conditions. It is merely necessary for sufficient pressure with intimate contact to be established between the metering, transfer and dampener form rolls so that substantially no slip occurs at the nips 64 and 66. The dampener assembly 10 is self-regulating, and no adjustment is necessary when switching coverage, plates, inks, papers, or in switching the unit from an integrated to a segregated mode where the oscillating roll 30 is moved away from contact with the ink form roll 20.

Industrial Applicability

The dampener assembly and method provides a simple, inexpensive automatic continuous duty dampener for a lithographic press which provides automatic ink-/water balance at all press speeds and with a variety of plates, inks, papers and fountain solution combinations without adjustment. The assembly will not emulsify ink in the dampener or inker even on long printing runs and even with somewhat non-absorbent sheet substrates or light coverage formats, and requires no circulation of fountain solution or temperature control thereof.

We claim:

1. In a lithographic press having a rotatable plate cylinder for carrying a lithographic printing plate, drive means for rotating the plate cylinder, and an inking system for providing ink to said plate cylinder, a dampening unit for automatically applying a controlled quantity of dampening fluid with ink to a lithographic printing plate on said plate cylinder comprising:

dampener support means;

metering roll means mounted for free rotating upon said dampener support means, said metering roll means including a metering roller having a hard hydrophylic surface for supporting a layer of dampening fluid;

a transfer roller mounted for free rotation upon said dampener support means and in continuous pressure contact with said metering roller to form a first nip therebetween, said transfer roller having a resilient ink-receptive surface for supporting an ink film;

a dampener form roller having an ink receptive surface mounted for rotation upon said support means in continuous pressure contact with said transfer roller to form a second nip therebetween, said dampener support means mounting said dampener form roller for pressure contact with said plate cylinder whereby said dampener form roller receives ink from said plate cylinder and provides a film of ink to said transfer roller;

dampener drive means connected to said dampener form roller for rotating said dampener form roller, and dampening fluid supply means for providing an abundant supply of dampening fluid to said metering roller, said dampening fluid supply means and metering roll means operating to provide a supply of dampening fluid to said first nip in excess of the amount of dampening fluid to be accepted by ink on the transfer roller and to return excess dampening fluid to said dampening fluid supply means;

wherein, said dampener support means mounts said metering roller in free wheeling relationship with said transfer roller at a present pressure sufficient to cause said metering roller to be rotated solely by friction with an ink layer on said transfer roller with substantially no shear of the ink and dampening fluid passing through said first nip, said dampener support means mounting said transfer roller in free wheeling relationship with said dampener form roller at a preset pressure sufficient to cause said transfer roller to be rotated solely by friction with said dampener form roller with substantially no shear of the ink and dampening fluid passing through said second nip.

2. The dampening unit of claim 1, wherein said dampener drive means drives said dampener form roller at substantially the same surface speed as said plate cylinder.

3. The dampening unit of claim 1, wherein said transfer and dampener form rollers re resilient ink receptive rollers, said transfer roller having a surface which is harder and less resilient than the surface of said dampener form roller.

4. The dampening unit of claim 3, wherein said transfer roller is a rubber roller having a durometer within a range of from 30 to 60 durometer and said dampener form roller is a rubber roller having a durometer within a range of from 20 to 30 durometer.

5. The dampening unit of claim 4, wherein said dampener form roller is of different diameter than said transfer roller.

6. The dampening unit of claim 1, wherein said dampener support means is operable to permit said dampener form roller to be separated from said plate cylinder while maintaining the pressure contact between said metering roller and transfer roller and said transfer roller and dampener form roller.

7. The dampening unit of claim 6, wherein said transfer and dampener form rollers are resilient ink receptive rollers, said transfer roller having a surface which is harder and less resilient than the surface of said dampener form roller.

8. The dampening unit of claim 1, wherein said transfer roller is a rubber roller having a durometer greater than 30 durometer and said dampener form roller is a rubber roller having a durometer within a range of from 20 to 30 durometer.

9. The dampening unit of claim 8, wherein said dampener form roller is of different diameter than said transfer roller.

10. The dampening unit of claim 8, wherein said dampening fluid supply means includes a pan for fountain solution mounted upon said dampener support means, said metering roller being mounted to rotate in said pan.

11. In a lithographic press having a rotatable plate cylinder for carrying a lithographic printing plate, drive means for rotating the plate cylinder, an inking system including an ink form roller for providing ink to said plate cylinder, an ink receptive, oscillating bridging roller, bridging roller mounting means and a dampening unit for automatically applying a controlled quantity of dampening fluid with ink to a lithographic printing plate on said plate cylinder comprising:

dampener support means;

metering roll means mounted for free rotation upon said dampener support means, said metering roll means including a metering roller having a hard hydrophylic surface for supporting a layer of dampening fluid;

a transfer roller mounted for free rotation upon said dampener support means and in continuous pressure contact with said metering roller to form a first nip therebetween, said transfer roller having a resilient ink-receptive surface for supporting an ink film;

a dampener form roller having an ink receptive surface mounted for rotation upon said support means in continuous pressure contact with said transfer roller to form a second nip therebetween, said dampener support means mounting said dampener form roller for pressure contact with said plate cylinder and said bridging roller whereby said dampener form roller receives ink from said plate cylinder and bridging roller and provides a film of ink to said transfer roller;

dampener drive means connected to said dampener form roller for rotating said dampener form roller, and dampening fluid supply means for providing an abundant supply of dampening fluid to said metering roller, said dampening fluid supply means and metering roller means operating to provide a supply of dampening fluid to said first nip in excess of the amount of dampening fluid to be accepted by ink on the transfer roller and to return excess dampening fluid to said dampening fluid supply means;

wherein, said dampener support means mounts said metering roller in free wheeling relationship with said transfer roller at a preset pressure sufficient to cause said metering roller to be rotated solely by friction with an ink layer on said transfer roller with substantially no shear of the ink and dampening fluid passing through said first nip, said dampener support means mounting said transfer roller in free wheeling relationship with said dampener form roller at a preset pressure sufficient to cause said transfer roller to be rotated solely by friction with said dampener form roller with substantially no shear of the ink and dampening fluid passing through said second nip, said dampener support means being operable to permit said dampener form roller to be separated from said plate cylinder while maintaining the pressure contact between said metering roller and transfer roller and transfer roller and dampener form roller.

12. The dampening unit of claim 11, wherein said bridging roller mounting means mounts said oscillating bridging roller for movement into and away from contact with said ink form roller.

13. A process for automatically controlling the ink-/dampening fluid film provided to the rotating plate cylinder of a lithographic press having an ink form roller in contact with said plate cylinder for providing ink thereto from an inking system which includes:

providing a supply of dampening fluid;

providing a rotatable, hydrophylic metering roller in contact with said supply of dampening fluid;

providing a rotatable, oleophylic transfer roller in continuous contact with said metering roller to create a first nip therebetween;

providing an ink and dampening fluid form roller having an ink receptive surface for carrying ink and dampening fluid in contact with said plate cylinder and in continuous contact with said transfer roller to create a second nip between said dampener form roller and said transfer roller and a third nip between said dampener form roller and said plate cylinder;

rotating said metering and transfer rollers at substantially the same surface speed to bring an ink film on said transfer roller into contact with dampening fluid on said metering roller at said first nip with substantially no shear of ink and dampening fluid passing through said first nip and to cause said metering roller to provide an unmetered supply of dampening fluid to said first nip in excess of the amount of dampening fluid which can be accepted by the ink film on said transfer roller; and simultaneously rotating said ink and dampening fluid form roller at substantially the same surface speed as said plate cylinder and said transfer roller to create substantially no shear between the dampening fluid and ink passing through said second and third nips;

wherein, said step of rotating said metering and transfer rollers is performed by applying pressure between the metering and transfer rollers at said first nip and between said transfer and dampener form rollers at said second nip to rotate said metering and transfer rollers solely by friction from said ink and dampening fluid form roller surface.

14. The process of claim 13, which includes providing an ink receptive bridging roller in contact with said ink form roller and said ink and dampening fluid form roller to apply ink to said ink and dampening fluid form roller which is applied by said ink and dampening fluid form roller to said transfer roller as an ink film.

15. The process of claim 14, which includes using water as said dampening fluid with no additional volatile additives.

16. The process of claim 15, which includes oscillating said bridging roller against said ink and dampening fluid form roller at a point after said ink and dampening fluid form roller has passed by said third nip to replenish the ink on said ink and dampening fluid form roller and to spread any remaining water.

17. In a lithographic press having a rotatable plate cylinder for carrying a lithographic printing plate, drive means for rotating the plate cylinder, and an inking system for providing ink to said plate cylinder, a dampening unit for automatically applying a controlled quantity of dampening fluid with ink to a lithographic printing plate on said plate cylinder comprising:

dampener support means;

dampening fluid supply means including a pan for dampening fluid mounted upon said dampener support means;

metering roll means mounted for free rotation upon said dampener support means to transfer dampening fluid from said pan, said metering roll means including a metering roller having a hard hydrophylic surface for supporting a layer of dampening fluid, said metering roller being mounted to bring said hydrophylic surface into contact with dampening fluid in said pan;

a transfer roller mounted for free rotation upon said dampener support means and in continuous pressure contact with said metering roller to form a first nip therebetween, said transfer roller having a resilient ink-receptive surface for supporting an ink film and bringing said ink film into contact with the dampening fluid on said metering roller at said first nip;

a dampener form roller having an ink receptive surface mounted for rotation upon said support means in continuous pressure contact with said transfer roller to form a second nip therebetween, said dampener support means mounting said dampener form roller for pressure contact with said plate cylinder whereby said dampener form roller receives ink from said plate cylinder and provides a film of ink to said transfer roller;

dampener drive means associated with said dampener form roller for rotating said dampener form roller, said dampener drive means causing said transfer and metering rollers to be rotated with substantially no slippage and shear of the ink and dampening fluid passing through said first nip and causing said transfer and dampener form rollers to be rotated with substantially no slippage and shear of the ink and dampening fluid passing through said second nip; said dampening fluid supply means providing an abundant supply of dampening fluid to said metering roller, said dampening fluid supply means and metering roll means operating to provide a supply of dampening fluid to said first nip in excess of the amount of dampening fluid to be accepted by ink on the transfer roller and to return excess dampening fluid to said pan.

* * * * *